US008606151B2

(12) United States Patent
Okamura

(10) Patent No.: US 8,606,151 B2
(45) Date of Patent: Dec. 10, 2013

(54) DEVELOPER SUPPLY DEVICE, DEVELOPER RETRIEVING DEVICE FOR THE SAME, AND IMAGE FORMING APPARATUS HAVING THE SAME

(75) Inventor: Mitsukiyo Okamura, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 243 days.

(21) Appl. No.: 13/072,473

(22) Filed: Mar. 25, 2011

(65) Prior Publication Data

US 2011/0311282 A1 Dec. 22, 2011

(30) Foreign Application Priority Data

Jun. 17, 2010 (JP) ..... 2010-138193

(51) Int. Cl.
*G03G 15/08* (2006.01)

(52) U.S. Cl.
USPC ..... 399/289; 399/283

(58) Field of Classification Search
USPC ..... 399/281, 283, 289
See application file for complete search history.

(56) References Cited

U.S. PATENT DOCUMENTS

| | | | | |
|---|---|---|---|---|
| 5,142,336 | A | 8/1992 | Hotomi et al. | |
| 6,272,296 | B1 | 8/2001 | Gartstein | |
| 6,901,231 | B1 | 5/2005 | Sakai et al. | |
| 8,095,052 | B2 * | 1/2012 | Nishiwaki et al. | 399/281 |
| 8,311,462 | B2 * | 11/2012 | Okamura | 399/265 |
| 8,326,188 | B2 * | 12/2012 | Nishiwaki | 399/266 |
| 2004/0213608 | A1 | 10/2004 | Sakuma et al. | |
| 2008/0013990 | A1 | 1/2008 | Samweber | |
| 2009/0136269 | A1 | 5/2009 | Aratachi | |
| 2009/0175662 | A1 * | 7/2009 | Nishiwaki | 399/281 |

(Continued)

FOREIGN PATENT DOCUMENTS

| | | | |
|---|---|---|---|
| JP | HEI 3-012678 | A | 1/1991 |
| JP | HEI 11-084862 | A | 3/1999 |

(Continued)

OTHER PUBLICATIONS

Notification of Reasons for Rejection dated Sep. 13, 2011 received from the Japanese Patent Office from related Japanese Application No. 2009-249798 and U.S. Appl. No. 12/894,879, together with an English-language translation.

(Continued)

*Primary Examiner* — Walter L Lindsay, Jr.
*Assistant Examiner* — Benjamin Schmitt
(74) *Attorney, Agent, or Firm* — Scully, Scott, Murphy & Presser, PC

(57) ABSTRACT

A developer supply device is provided, which includes a developer retrieving board disposed in closest proximity to a developer holding surface parallel to a first direction, across a predetermined distance in a retrieving proximity position that is downstream relative to a first position where a developer holding surface faces an intended device to be supplied with development agent and upstream relative to a second position that is upstream relative to the first position and a position where the development agent is transferred onto the developer holding surface, in a second direction as a moving direction of the developer holding surface which direction is perpendicular to the first direction. The developer retrieving board retrieves the development agent from the developer holding surface in a position downstream relative to the retrieving proximity position in a developer transfer direction along a developer retrieving path perpendicular to the first direction.

12 Claims, 7 Drawing Sheets

(56) References Cited

U.S. PATENT DOCUMENTS

| | | | | |
|---|---|---|---|---|
| 2009/0232562 | A1 | 9/2009 | Hazeyama | |
| 2009/0238611 | A1 | 9/2009 | Hazeyama | |
| 2009/0297228 | A1* | 12/2009 | Maeda et al. | 399/266 |
| 2011/0103849 | A1 | 5/2011 | Nishiwaki | |
| 2011/0236078 | A1* | 9/2011 | Takahashi et al. | 399/281 |
| 2011/0293335 | A1* | 12/2011 | Takahashi et al. | 399/281 |
| 2012/0027471 | A1* | 2/2012 | Nishigaki et al. | 399/281 |
| 2012/0201576 | A1* | 8/2012 | Uno et al. | 399/281 |

FOREIGN PATENT DOCUMENTS

| | | | | |
|---|---|---|---|---|
| JP | 2001-209246 | | 8/2001 | |
| JP | 2002-116620 | | 4/2002 | |
| JP | 2002-287495 | | 10/2002 | |
| JP | 2003-280388 | | 10/2003 | |
| JP | 2004-198675 | | 7/2004 | |
| JP | 2006-047654 | | 2/2006 | |
| JP | 2008-070803 | A | 3/2008 | |
| JP | 2008-83237 | | 4/2008 | |
| JP | 2008-523429 | * | 7/2008 | G03G 15/08 |
| JP | 2008-523429 | A | 7/2008 | |
| JP | 2009-229674 | A | 10/2009 | |
| JP | 2011-095525 | A | 5/2011 | |

OTHER PUBLICATIONS

U.S. Office Action dated Feb. 20, 2013, received in related U.S. Appl. No. 12/894,879.

U.S. Office Action dated Jun. 7, 2013 in U.S. Appl. No. 12/894,879.

* cited by examiner

Z

DEVELOPER SUPPLY DEVICE, DEVELOPER RETRIEVING DEVICE FOR THE SAME, AND IMAGE FORMING APPARATUS HAVING THE SAME

CROSS-REFERENCE TO RELATED APPLICATION

This application claims priority under 35 U.S.C. §119 from Japanese Patent Application No. 2010-138193 filed on Jun. 17, 2010. The entire subject matter of the application is incorporated herein by reference.

BACKGROUND

1. Technical Field

The following description relates to one or more techniques for retrieving development agent from a developer holding surface that is a cylindrical surface parallel to a main scanning direction.

2. Related Art

A developer supply device has been known that includes a developer holding member (a development roller), an upstream developer transfer unit, and a downstream developer transfer unit.

The developer holding member is disposed to face an electrostatic latent image holding body (a photoconductive drum) in a predetermined development area. The developer holding member has a developer holding surface on which charged development agent is held and carried.

The upstream developer transfer unit has an upstream transfer surface. The upstream transfer surface is disposed to face the developer holding surface across a predetermined distance at an upstream side relative to the development area in a moving direction of the developer holding surface. The upstream developer transfer unit is configured to generate an upstream transfer electric field (an electric field for transferring the development agent carried on the upstream transfer surface from an upstream side to a downstream side in the moving direction of the developer holding member).

The downstream developer transfer unit has a downstream transfer surface. The downstream transfer surface is disposed to face the developer holding surface across a predetermined distance at a downstream side relative to the development area in the moving direction of the developer holding surface. The downstream developer transfer unit is configured to generate a downstream transfer electric field (an electric field for transferring the development agent carried on the downstream transfer surface from the upstream side to the downstream side in the moving direction of the developer holding member).

In the above configuration, an electric field for transferring the charged development agent from the upstream side to the downstream side in the moving direction of the developer holding member is generated in a space on each of the upstream transfer surface and the downstream transfer surface. Thereby, the development agent is transferred from the upstream side to the downstream side in the moving direction of the developer holding member, on each of the upstream transfer surface and the downstream transfer surface.

The development agent, transferred by the upstream developer transfer unit, faces the developer holding surface in a position where the upstream transfer surface faces the developer holding surface (a circumferential surface of the development roller). Thereby, the development agent adheres onto the developer holding surface. In other words, the development agent is held and carried on the developer holding surface.

A part of the development agent held on the developer holding surface is consumed in the development area where the part of the development agent is supplied for development of an electrostatic latent image. Namely, when reaching the development area, the part of the development agent held on the developer holding surface adheres onto positions corresponding to the electrostatic latent image formed on the electrostatic latent image holding surface that is a circumferential surface of the electrostatic latent image holding body).

The other remaining part of the development agent held on the developer holding surface, which remaining part has not adheres onto the electrostatic latent image holding surface (not been consumed in the development area), is retrieved by the downstream developer transfer unit, and transferred from the upstream side to the downstream side in the moving direction of the developer holding member (in a rotational direction of the development roller) on the downstream transfer surface.

SUMMARY

In a developer supply device of this kind, when the development agent remaining on the developer holding surface without being consumed in the development area is not retrieved in a favorable manner, it might result in formation of a low-quality image.

Aspects of the present invention are advantageous to provide one or more improved techniques for a developer supply device, which techniques make it possible to retrieve development agent remaining on a developer holding surface in a favorable manner.

According to aspects of the present invention, a developer supply device is provided, which is configured to supply charged development agent to an intended device. The developer supply device includes a casing including a developer storage section configured to accommodate the development agent to be supplied, a developer holding member including a developer holding surface formed as a cylindrical circumferential surface parallel to a first direction, the developer holding surface being disposed to face the intended device in a first position outside the casing, the developer holding member being configured to rotate around an axis parallel to the first direction such that the developer holding surface moves in a second direction perpendicular to the first direction, a developer transfer unit configured to transfer the development agent from the developer storage section onto the developer holding surface in a second position upstream relative to the first position in the second direction, and a developer retrieving board including a plurality of retrieving transfer electrodes arranged along a developer retrieving path perpendicular to the first direction. The developer retrieving board is disposed in closest proximity to the developer holding surface across a predetermined distance in a retrieving proximity position that is downstream relative to the first position and upstream relative to the second position in the second direction. The developer retrieving board is configured to retrieve the development agent from the developer holding surface in a position downstream relative to the retrieving proximity position in a developer transfer direction along the developer retrieving path, under an electric field generated when a retrieving bias voltage is applied between the developer holding member and the developer retrieving board, and to transfer the retrieved development agent toward the developer storage section in the developer transfer direction along the developer retrieving path.

According to aspects of the present invention, further provided is a developer supply device configured to supply charged development agent to an intended device. The developer supply device includes a casing including a developer storage section configured to accommodate the development agent to be supplied, a developer holding member including a developer holding surface formed as a cylindrical circumferential surface parallel to a first direction, the developer holding surface being disposed to face the intended device in a first position outside the casing, the developer holding member being configured to rotate around an axis parallel to the first direction such that the developer holding surface moves in a second direction perpendicular to the first direction, a developer transfer unit configured to transfer the development agent from the developer storage section onto the developer holding surface in a second position upstream relative to the first position in the second direction, a developer retrieving member configured as a substantially cylindrical rotational body disposed to face the developer holding surface in a third position that is downstream relative to the first position and upstream relative to the second position in the second direction, the developer retrieving member retrieving the development agent from the developer holding surface when a first retrieving bias voltage is applied between the developer holding member and the developer retrieving member, and a developer retrieving board including a plurality of retrieving transfer electrodes arranged along a developer retrieving path perpendicular to the first direction. The developer retrieving board is disposed in closest proximity to the developer retrieving member across a predetermined distance in a retrieving proximity position different from the third position. The developer retrieving board is configured to retrieve the development agent from the developer retrieving member in a position downstream relative to the retrieving proximity position in a developer transfer direction along the developer retrieving path, under an electric field generated when a second retrieving bias voltage is applied between the developer retrieving member and the developer retrieving board, and to transfer the retrieved development agent toward the developer storage section in the developer transfer direction along the developer retrieving path.

According to aspects of the present invention, further provided is a developer retrieving device configured to retrieve charged development agent from a developer holding surface formed as a cylindrical circumferential surface parallel to a first direction. The developer retrieving device includes a developer retrieving board including a plurality of retrieving transfer electrodes arranged along a developer retrieving path perpendicular to the first direction. The developer retrieving board is disposed in closest proximity to the developer holding surface across a predetermined distance in a retrieving proximity position upstream relative to a developer carrying position, in which the developer holding surface holds and carries the development agent, in a second direction that is a moving direction of the developer holding surface and perpendicular to the first direction. The developer retrieving board is configured to retrieve the development agent from the developer holding surface in a position downstream relative to the retrieving proximity position in a developer transfer direction along the developer retrieving path, under an electric field generated when a retrieving bias voltage is applied between the developer holding member and the developer retrieving board, and to transfer the retrieved development agent toward a position farther from the retrieving proximity position in the developer transfer direction along the developer retrieving path.

According to aspects of the present invention, further provided is an image forming apparatus, which includes a photoconductive body configured such that a development agent image is formed thereon, and a developer supply device configured to supply charged development agent to the photoconductive body, the developer supply device including a casing including a developer storage section configured to accommodate the development agent to be supplied, a developer holding member including a developer holding surface formed as a cylindrical circumferential surface parallel to a first direction, the developer holding surface being disposed to face the photoconductive body in a first position outside the casing, the developer holding member being configured to rotate around an axis parallel to the first direction such that the developer holding surface moves in a second direction perpendicular to the first direction, a developer transfer unit configured to transfer the development agent from the developer storage section onto the developer holding surface in a second position upstream relative to the first position in the second direction, and a developer retrieving board including a plurality of retrieving transfer electrodes arranged along a developer retrieving path perpendicular to the first direction. The developer retrieving board is disposed in closest proximity to the developer holding surface across a predetermined distance in a retrieving proximity position that is downstream relative to the first position and upstream relative to the second position in the second direction. The developer retrieving board is configured to retrieve the development agent from the developer holding surface in a position downstream relative to the retrieving proximity position in a developer transfer direction along the developer retrieving path, under an electric field generated when a retrieving bias voltage is applied between the developer holding member and the developer retrieving board, and to transfer the retrieved development agent toward the developer storage section in the developer transfer direction along the developer retrieving path.

BRIEF DESCRIPTION OF THE ACCOMPANYING DRAWINGS

Figure 4:
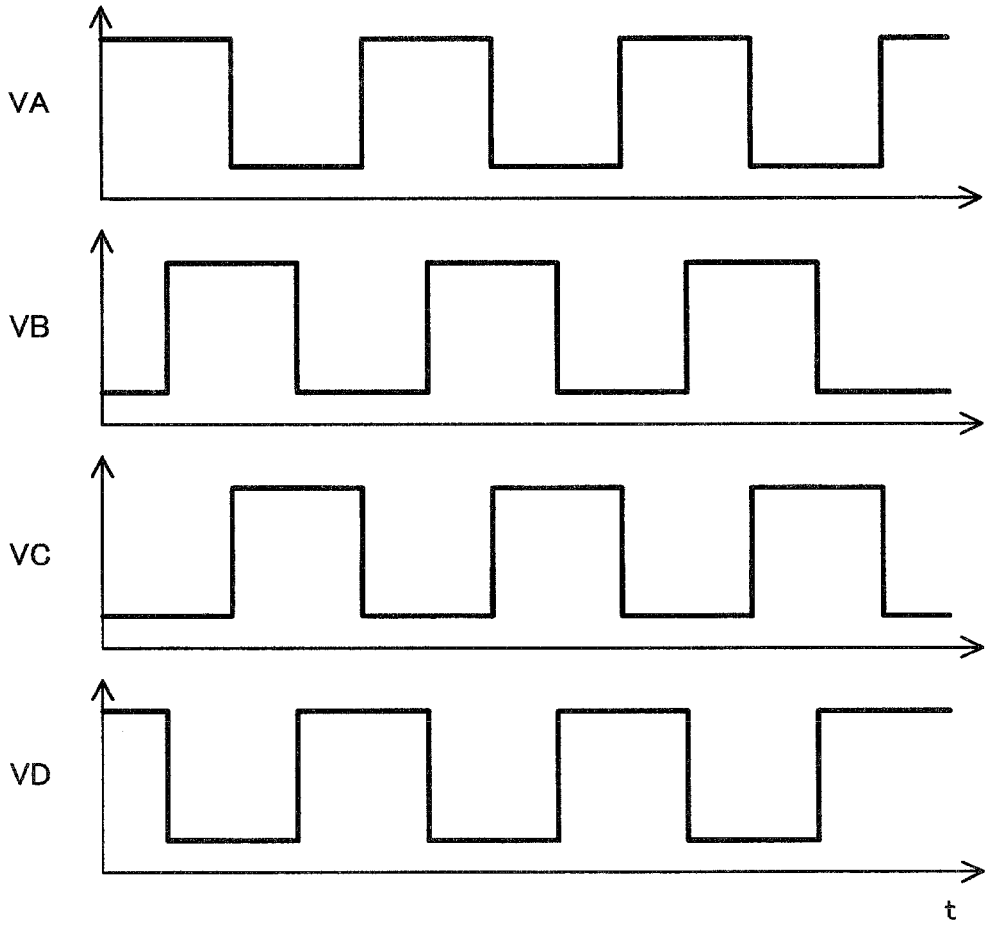

FIG. 4 exemplifies respective waveforms of voltages output from four power supply circuits for each transfer board in the embodiment according to one or more aspects of the present invention.

Figure 5:
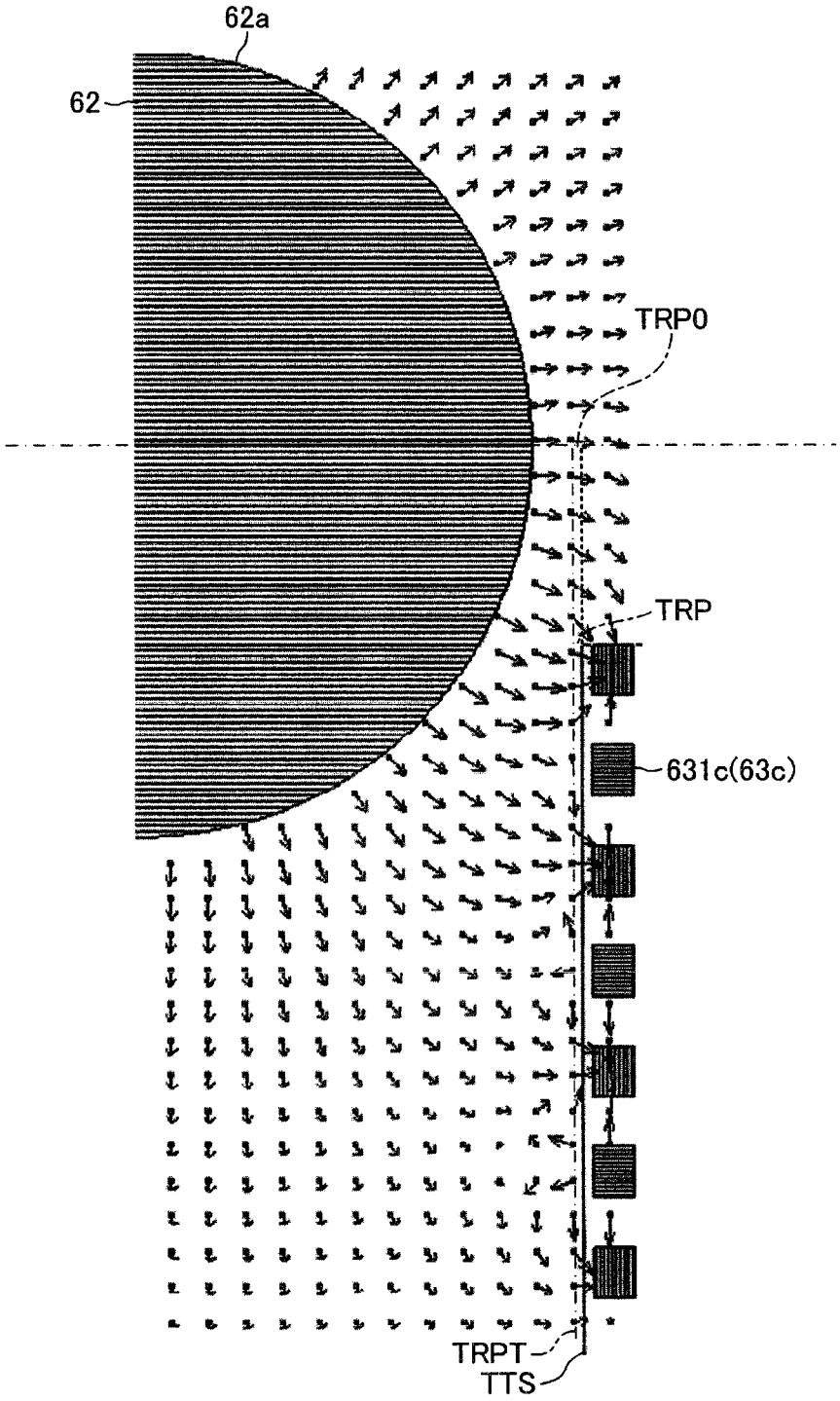
Figure 6:
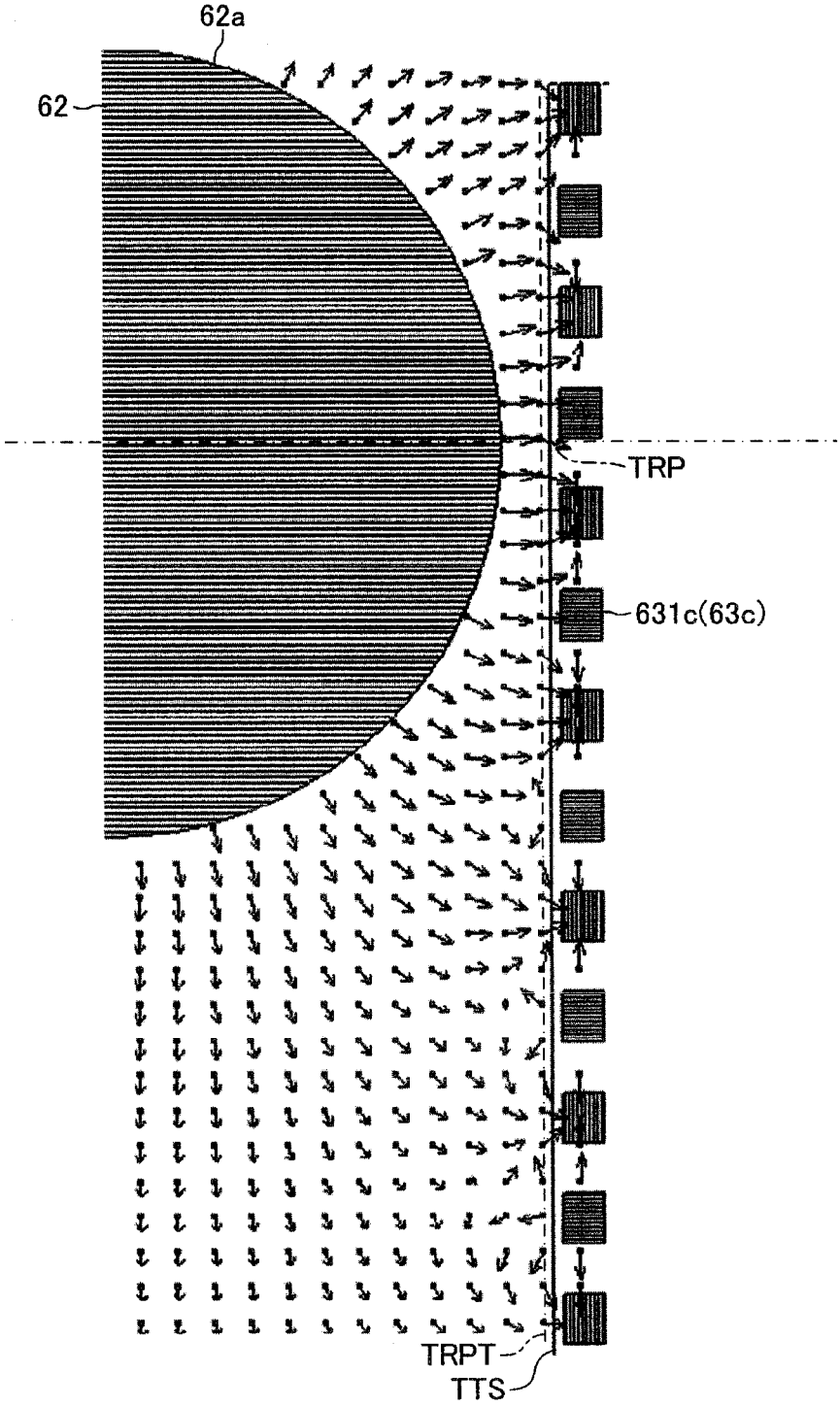

FIGS. 5 and 6 show simulation results of electric fields generated around a development roller (toner holding surface) and a retrieving transfer board, in order to illustrate operations and effects of the toner supply device in the embodiment according to one or more aspects of the present invention.

Figure 7:
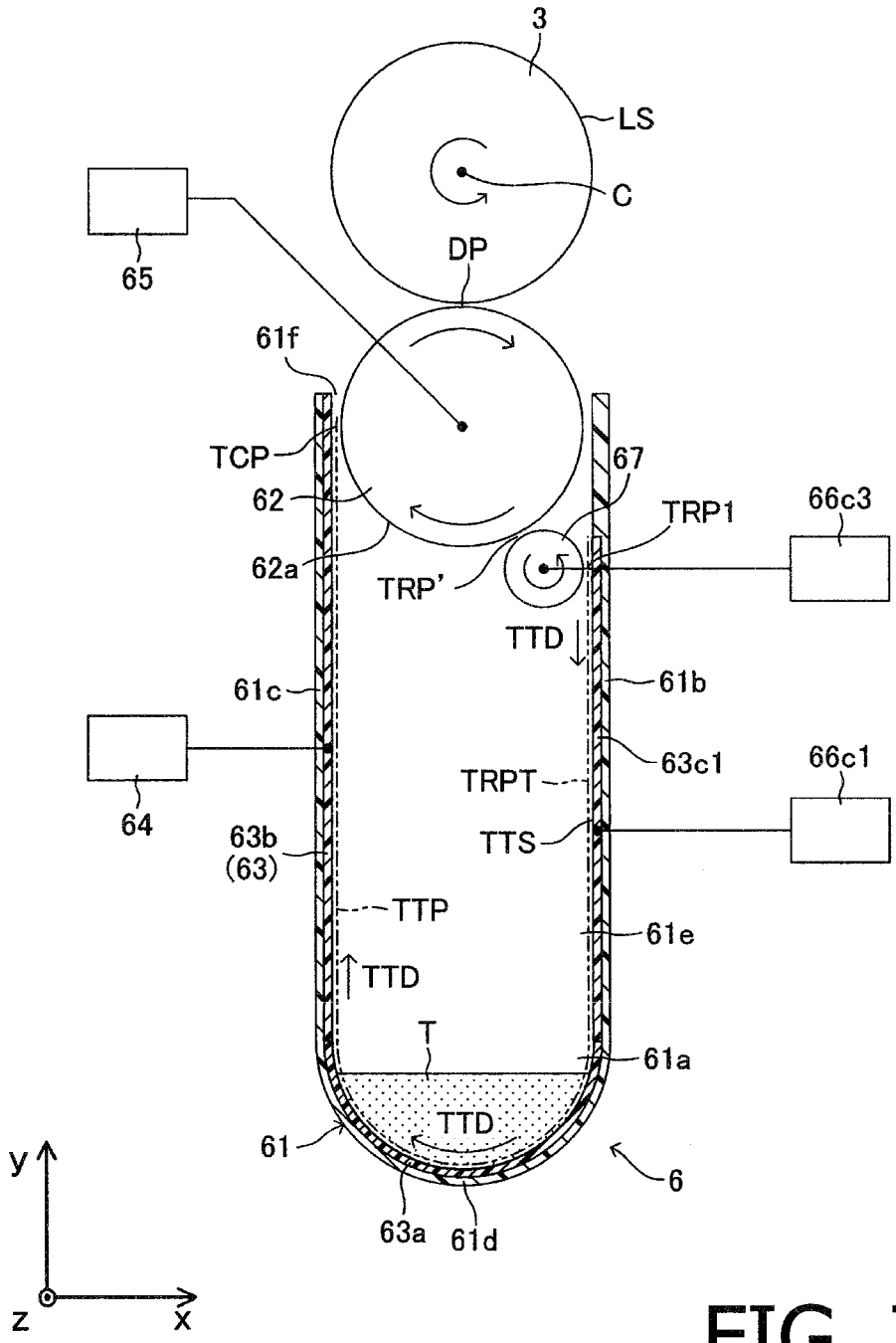

FIG. 7 is an enlarged cross-sectional side view of a toner supply device for the laser printer in a modification according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an embodiment according to aspects of the present invention will be described with reference to the accompany drawings.

<Configuration of Laser Printer>

Figure 1:
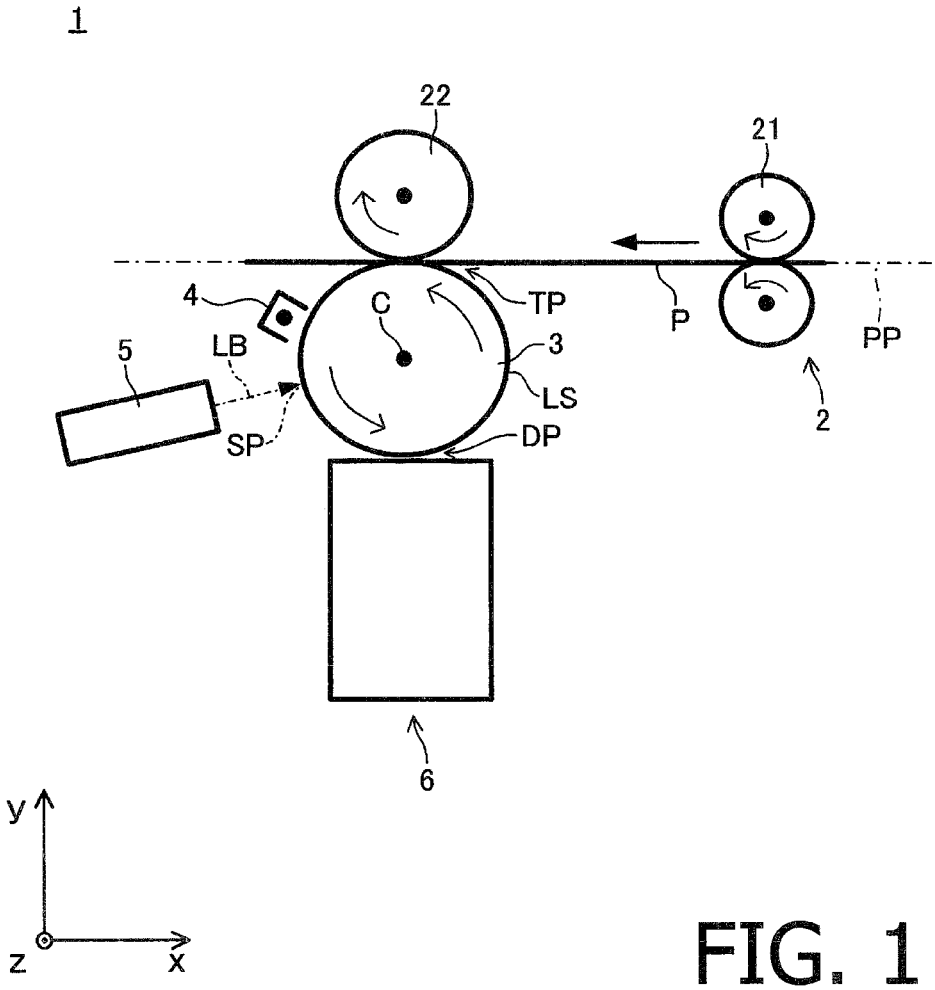
FIG. 1 is a side view schematically showing a configuration of a laser printer in an embodiment according to one or more aspects of the present invention.

As illustrated in FIG. 1, a laser printer 1 includes a sheet feeding mechanism 2, a photoconductive drum 3, an electrification device 4, a scanning unit 5, and a toner supply device 6.

A feed tray (not shown), provided in the laser printer 1, is configured such that a stack of sheets P is placed thereon. The sheet feeding mechanism 2 is configured to feed the sheets P placed on the feed tray, on a sheet-by-sheet basis along a predetermined sheet feeding path PP.

On a circumferential surface of the photoconductive drum 3, an electrostatic latent image holding surface LS is formed as a cylindrical surface parallel to a main scanning direction (i.e., a z-axis direction in FIG. 1, hereinafter which may be referred to as a width direction). The electrostatic latent image holding surface LS is configured such that an electrostatic latent image is formed thereon in accordance with an electric potential distribution. Further, the electrostatic latent image holding surface LS is configured to hold toner T (see FIG. 2) in positions corresponding to the electrostatic latent image. The photoconductive drum 3 is driven to rotate in a predetermined direction (counterclockwise in FIG. 1) around a central axis parallel to the main scanning direction. Thereby, the photoconductive drum 3 is configured to move the electrostatic latent image holding surface LS along an auxiliary scanning direction perpendicular to the main scanning direction.

The electrification device 4 is disposed to face the electrostatic latent image holding surface LS, so as to evenly and positively charge the electrostatic latent image holding surface LS. The scanning unit 5 is configured to generate a laser beam LB modulated based on image data and to scan the laser beam LB, which is converged in a scanned position SP on the electrostatic latent image holding surface LS, along the main scanning direction. Namely, the scanning unit 5 is configured such that an electrostatic latent image is formed on the electrostatic latent image holding surface LS.

The toner supply device 6 is disposed under the photoconductive body 3, so as to face the photoconductive body 3 in a development position DP which is downstream relative to the scanned position SP in a moving direction of the electrostatic latent image holding surface LS moving in response to rotation of the photoconductive drum 3. The toner supply device 6 is configured to supply the positively charged toner T (see FIG. 2) from underneath to the electrostatic latent image holding surface LS in the development position DP. Subsequently, a detailed explanation will be provided about a specific configuration of each element included in the laser printer 1.

The sheet feeding mechanism 2 includes a pair of registration rollers 21 and a transfer roller 22. The registration rollers 21 are configured to feed a sheet P toward a transfer position TP (which is downstream relative to the development position DP in the moving direction of the electrostatic latent image holding surface LS moving in response to rotation of the photoconductive drum 3) between the photoconductive drum 3 and the transfer roller 22 at a predetermined moment.

The transfer roller 22 is disposed to face the electrostatic latent image holding surface LS across the sheet feeding path PP (the sheet P) in the transfer position TP. Additionally, the transfer roller 22 is driven to rotate in a direction (clockwise in FIG. 1) opposite to the rotational direction of the photoconductive drum 3. Further, the transfer roller 22 is connected with a transfer bias power supply circuit (not shown), such that a predetermined transfer bias voltage is applied for transferring, onto the sheet P, the toner T (see FIG. 2) adhering onto the electrostatic latent image holding surface LS.

<<Toner Supply Device>>

Figure 2:
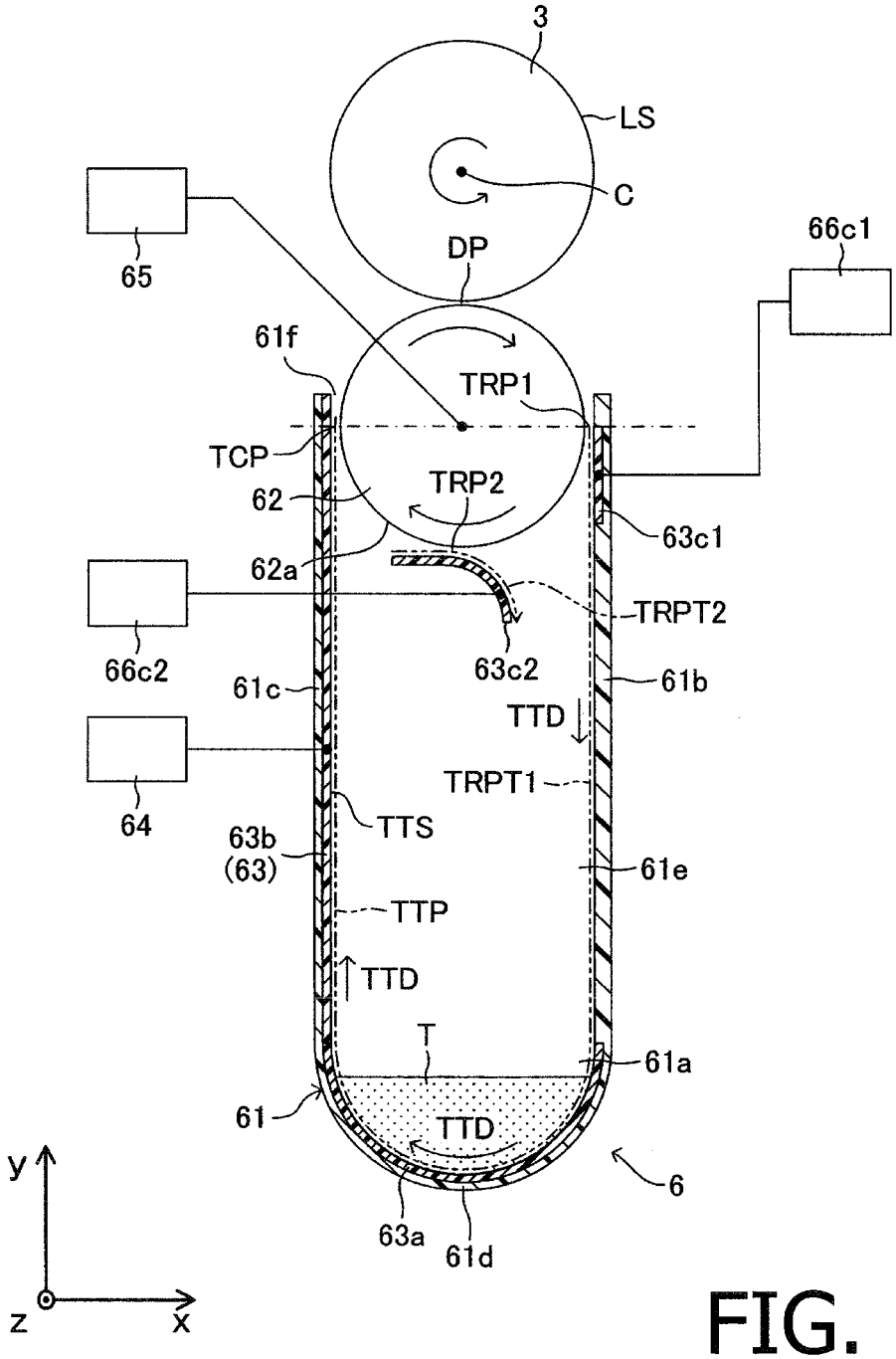
FIG. 2 is an enlarged cross-sectional side view of a toner supply device for the laser printer in the embodiment according to one or more aspects of the present invention.

As depicted in FIG. 2 that is a cross-sectional side view (a cross-sectional view along a plane with the main scanning direction as a normal line) showing the toner supply device 6 in an enlarged manner, a toner box 61 as a casing of the toner supply device 6 is a box-shaped member that is formed substantially in an upward-open "U" shape when viewed in the z-axis direction. Further, the toner box 61 is disposed to have a longitudinal direction parallel to an up-to-down direction (i.e., the y-axis direction in FIG. 2, which may be referred to as a vertical direction).

The toner box 61 includes a toner storage section 61*a* formed at a bottom inside therein. The toner storage section 61*a* is configured to accommodate the powdered toner T. It is noted that in the embodiment, the toner T is positively-chargeable nonmagnetic-one-component black toner. The toner box 61 includes a rear panel 61*b*, a front panel 61*c*, a bottom plate 61*d*, and two side panels 61*e*.

The rear panel 61*b* is a flat plate member disposed parallel to the main scanning direction and the up-to-down direction. The rear panel 61*b* stands to be perpendicular to the horizontal plane. The front panel 61*c* is a flat plate member disposed parallel to the rear panel 61*b*. The front panel 61*c* stands to be perpendicular to the horizontal plane. The rear panel 61*b* and the front panel 61*c* are provided to face each other, such that respective upper ends thereof have the same height and extend parallel to the main scanning direction.

The bottom plate 61*d* is an upward-open half-cylindrical member having a central axis line parallel to the main scanning direction. The bottom plate 61*d* is connected with respective lower ends of the rear panel 61*b* and the front panel 61*c*. In other words, each of the rear panel 61*b* and the front panel 61*c* extends from a corresponding one of upper ends of the bottom plate 61*d* toward the photoconductive drum 3. Further, the two side panels 61*e* are provided to shield both sides of a synthetic resin frame in the z-axis direction, which frame is formed integrally with the rear panel 61*b*, the front panel 61*c*, and the bottom plate 61*d* and substantially formed in a "U" shape when viewed in the z-axis direction.

A toner storage section 61*a* is formed at a bottom of a space surrounded by the rear panel 61*b*, the front panel 61*c*, the bottom plate 61*d*, and the two side panels 61*e*. Further, an opening 61*f* is formed by upper ends of the rear panel 61*b*, the front panel 61*c*, and the two side panels 61*e*. The opening 61*f* is open up toward the photoconductive drum 3.

By the toner box 61, a development roller 62 is supported rotatably around an axis parallel to the main scanning direction. The development roller 62 is a roller-shaped member having a toner holding surface 62*a* that is a cylindrical circumferential surface parallel to the main scanning direction. The development roller 62 is disposed at an upper end of the toner box 61, such that a part (as shown in FIG. 2, a nearly upper half portion) of the toner holding surface 62*a* is exposed to the outside of the toner box 61 via the opening 61*f*, and that in the development position DP, the nearly upper half portion of the toner holding surface 62*a* is in proximity to and opposite the electrostatic latent image holding surface LS of the photoconductive drum 3 across a predetermined distance. Namely, the development roller 62 is partially housed in the toner box 61 such that its rotational center axis parallel to the main scanning direction is placed inside the toner box 61 and the nearly upper half portion thereof is exposed to the outside of the toner box 61.

In the embodiment, the development roller 62 is driven to rotate in a direction (clockwise in FIG. 2) opposite to the rotational direction of the photoconductive drum 3, such that a moving direction of the toner holding surface 62*a* is substantially the same as the moving direction of the electrostatic latent image holding surface LS in the development position DP. Namely, the development roller 62 is driven to rotate such that the toner holding surface 62*a* moves from a side closer to the front panel 61*c* toward a side closer to the rear panel 61*b* when viewed from above (from the side of the photoconductive drum 3).

<<<Transfer Board>>>

A transfer board 63 is provided inside the toner box 61. In the embodiment, the transfer board 63 includes a bottom transfer board 63*a*, a vertical transfer board 63*b*, a first retrieving transfer board 63*c*1, and a second retrieving transfer board 63*c*2. The transfer board 63 is configured to transfer the toner T along a toner transfer surface TTS as a surface of the transfer board 63 (a toner transfer path TTP) under a traveling-wave electric field. It is noted that a detailed explanation will be provided below about an internal configuration of the transfer board 63 (the bottom transfer board 63*a*, the vertical transfer board 63*b*, the first retrieving transfer board 63*c*1, and the second retrieving transfer board 63*c*2).

The "toner transfer path TTP" is a transfer path for the toner T that is formed along the toner transfer surface TTS and provided with a below-mentioned first toner retrieving path TRPT1 and a below-mentioned second toner retrieving path TRPT2. Further, a tangential direction in a given position on the toner transfer path TTP, which direction is identical to a direction in which the positively charged toner T is transferred, will hereinafter be referred to as a "toner transfer direction TTD."

The bottom transfer board 63*a* is fixed onto an inner wall surface of the bottom plate 61*d* so as to form a bottom surface of the toner storage section 61*a*. The bottom transfer board 63*a* is an upward-open curved plate member that is bent substantially in a semicircle shape when viewed in the z-axis direction. A downstream end (an upper left end in FIG. 2) of the bottom transfer board 63*a* in the toner transfer direction TTD is smoothly connected with a lower end of the vertical transfer board 63*b*, so as to smoothly transfer the toner T stored in the toner storage section 61*a* to the vertical transfer board 63*b*.

The vertical transfer board 63*b* is fixed onto an inner wall surface of the front panel 61*c*. The vertical transfer board 63*b* extends vertically so as to transfer the toner T vertically upward from the lower end thereof connected with the bottom transfer board 63*a*. The upper end of the vertical transfer board 63*b* is disposed as high as the center of the development roller 62 (more specifically, to be slightly higher than the center of the development roller 62). Further, the upper end of the vertical transfer board 63*b* is disposed to face the cylindrical-surface-shaped toner holding surface 62*a*. In a toner carrying position TCP where the vertical transfer board 63*b* is in closest proximity to and opposite the toner holding surface 62*a*, there is a predetermined distance of gap provided between the vertical transfer board 63*b* and the toner holding surface 62*a*.

In the embodiment, the bottom transfer board 63*a* and the vertical transfer board 63*b* are formed integrally in a seamless manner in a mirror-inverted "J" shape when viewed in the z-axis direction. Namely, along the surfaces of the bottom transfer board 63*a* and the vertical transfer board 63*b*, the toner transfer path TTP is formed in a mirror-inverted "J" shape when viewed in the main scanning direction (the z-axis direction). Further, the vertical transfer board 63*b* is configured to transfer the toner T, received from the bottom transfer board 63*a*, vertically up toward the toner carrying position TCP which is upstream relative to the development position DP in the moving direction of the toner holding surface 62*a* moving in response to rotation of the development roller 62.

The first retrieving transfer board 63*c*1 is fixed onto an inner wall surface of the rear panel 61*b* in a position opposite the upper end of the vertical transfer board 63*b* across the development roller 62. The first retrieving transfer board 63*c*1 is disposed in the vicinity of the opening 61*f*, such that the toner transfer surface TTS thereof is in closest proximity to and opposite the toner holding surface 62*a* in a first-retrieving-side proximity position TRP1. The first-retrieving-side proximity position TRP1 is a position near the opening 61*f*, namely, the upper end of the rear panel 61*b*, which position is placed downstream relative to the development position DP and upstream relative to the toner carrying position TCP in the moving direction in which the toner holding surface 62*a* moves in response to rotation of the development roller 62. In the first-retrieving-side proximity position TRP1, a predetermined distance of gap is provided between the first retrieving transfer board 63*c*1 and the toner holding surface 62*a*.

In the embodiment, the first retrieving transfer board 63*c*1 is formed as a flat plate parallel to the vertical transfer board 63*b*. Namely, the first toner retrieving path TRPT1, which is a transfer path for the toner T transferred by the first retrieving transfer board 63*c*1, is formed as a straight line extending vertically downward from the first-retrieving-side proximity position TRP1 along a surface of the first retrieving transfer board 63*c*1 when viewed in the main scanning direction (the z-axis direction).

A starting point (an upstream end) of the first retrieving transfer board 63*c*1 in the toner transfer direction TTD is disposed in a position corresponding to (specifically, as high as) the first-retrieving-side proximity position TRP1. Namely, the starting point of the first retrieving transfer board 63*c*1 in the toner transfer direction TTD is disposed in a position corresponding to (specifically, as high as) the rotation center of development roller 62. An end point (a downstream end) of the first retrieving transfer board 63*c*1 in the toner transfer direction TTD is disposed in a position corresponding to the vicinity of a lower end of the development roller 62. The first retrieving transfer board 63*c*1 retrieves the toner T, which remains on the toner holding surface 62*a* without being consumed in the development position DP, from the development roller 62 (the toner holding surface 62*a*) in the first-retrieving-side proximity position TRP1. Further, the first retrieving transfer board 63*c*1 transfers the retrieved toner T vertically down toward the toner storage section 61*a* along the first retrieving transfer board 63*c*1. The toner T transferred by the first retrieving transfer board 63*c*1 passes through the downstream end of the first retrieving transfer board 63*c*1 on the first toner retrieving path TRPT1 and thereafter drops down.

In the embodiment, the first retrieving transfer board 63*c*1 is configured and disposed to retrieve the toner T in a downstream position on the first toner retrieving path TRPT1 relative to the first-retrieving-side proximity position TRP1 in the toner transfer direction TTD. Further, the first retrieving transfer board 63*c*1 is provided such that the toner transfer direction TTD is substantially identical to the moving direction in which the toner holding surface 62*a* moves in response to rotation of the development roller 62 in the vicinity of the first-retrieving-side proximity position TRP1.

The second retrieving transfer board 63*c*2 is disposed beneath the development roller 62. Specifically, the second retrieving transfer board 63*c*2 is disposed is a position where the toner transfer surface TTS thereof is in closest proximity to and opposite the toner holding surface 62*a* in a second-retrieving-side proximity position TRP2. The second-retrieving-side proximity position TRP2 is a position inside the toner box 61, which position is placed downstream relative to the development position DP and the first-retrieving-side proximity position TRP1 and upstream relative to the toner carrying position TCP in the moving direction in which the toner holding surface 62*a* moves in response to rotation of the development roller 62. In the second-retrieving-side proximity position TRP2, a predetermined distance of gap is provided between the second retrieving transfer board 63*c*2 and the toner holding surface 62*a*.

In the embodiment, the second retrieving transfer board 63*c*2 includes a horizontal flat plate portion disposed downstream (at a left side in FIG. 2) relative to the second-retrieving-side proximity position TRP2 in the moving direction of the toner holding surface 62*a* moving in response to rotation of the development roller 62, and a curved plate portion that is bent obliquely down and disposed upstream (at a right side in FIG. 2) relative to the second-retrieving-side proximity position TRP2 in the moving direction. Further, the second retrieving transfer board 63*c*2 is formed in a fallen "J" shape when viewed in the z-axis direction. Along a surface of the second retrieving transfer board 63*c*2, a second toner retrieving path TRPT2 is formed in a fallen "J" shape when viewed in the z-axis direction.

The second retrieving transfer board 63*c*2 retrieves the toner T, which remains on the toner holding surface 62*a* without being retrieved by the first retrieving transfer board 63*c*1, from the toner holding surface 62*a* in the second-retrieving-side proximity position TRP2. Further, the second retrieving transfer board 63*c*2 transfers the retrieved toner T along the second toner retrieving path TRPT2, down toward the toner storage section 61*a*. In the embodiment, the second retrieving transfer board 63*c*2 is configured such that the toner transfer direction TTD is opposite to the moving direction of the toner holding surface 62*a* moving in response to rotation of the development roller 62, in the second-retrieving-side proximity position TRP2.

Thus, in the embodiment, the second retrieving transfer board 63*c*2 is disposed to face the toner holding surface 62*a* in a different position from the first retrieving transfer board 63*c*1. Specifically, the second retrieving transfer board 63*c*2 is disposed downstream relative to the first retrieving transfer board 63*c*1 in the moving direction of the toner holding surface 62*a* moving in response to rotation of the development roller 62.

The bottom transfer board 63*a* and the vertical transfer board 63*b* are electrically connected with a transfer power supply circuit 64. The development roller 62 is electrically connected with a development bias power supply circuit 65. The first retrieving transfer board 63*c*1 is electrically connected with a first retrieving bias power supply circuit 66*c*1. The second retrieving transfer board 63*c*2 is electrically connected with a second retrieving bias power supply circuit 66*c*2.

The transfer power supply circuit 64 is configured to output a voltage (which typically contains a direct-current (DC) bias component and a multi-phase alternating-current (AC) bias component) required for transferring the toner T in the toner transfer direction TTD along the toner transfer path TTP. The first retrieving bias power supply circuit 66*c*1 is configured to output a voltage (which typically contains a DC bias component and a multi-phase AC bias component) required for transferring the toner T along the first toner retrieving path TRPT1. In the same manner, the second retrieving bias power supply circuit 66*c*2 is configured to output a voltage (which typically contains a DC bias component and a multi-phase AC bias component) required for transferring the toner T along the second toner retrieving path TRPT2. The development bias power supply circuit 65 is configured to output a voltage (which typically contains a DC bias component and an AC bias component) required for transferring the toner T held on the toner holding surface 62*a* onto the electrostatic latent image holding surface LS.

In the embodiment, the DC bias component and the AC bias component of the voltage output from each of the transfer power supply circuit 64, the development bias power supply circuit 65, the first retrieving bias power supply 66*c*1, and the second retrieving bias power supply circuit 66*c*2 are set appropriately as needed. Thereby, a supply bias voltage is applied between the development roller 62 and the vertical transfer board 63*b* such that the toner T is transferred from the vertical transfer board 63*b* onto the toner holding surface 62*a* in the toner carrying position TCP. In addition, a first retrieving bias voltage is applied between the development roller 62 and the first retrieving transfer board 63*c*1 such that the toner T is retrieved from the toner holding surface 62*a* by the first retrieving transfer board 63*c*1 in the first-retrieving-side proximity position TRP1 and the retrieved toner T is conveyed along the first toner retrieving path TRPT1. Further, a second retrieving bias voltage is applied between the development roller 62 and the second retrieving transfer board 63*c*2 such that the toner T is retrieved from the toner holding surface 62*a* by the second retrieving transfer board 63*c*2 in the second-retrieving-side proximity position TRP2 and the retrieved toner T is conveyed along the second toner retrieving path TRPT2.

Especially, in the embodiment, the second retrieving bias voltage is set to be higher than the first retrieving bias voltage. Namely, the DC bias component of the voltage output from each of the development bias power supply circuit 65, the first retrieving bias power supply circuit 66*c*1, and the second retrieving bias power supply circuit 66*c*2 is set appropriately as needed such that the electric field generated for retrieving the toner T in the second-retrieving-side proximity position TRP2 is higher than that in the first-retrieving-side proximity position TRP1.

<<<Internal Configuration of Transfer Board>>>

Figure 3:
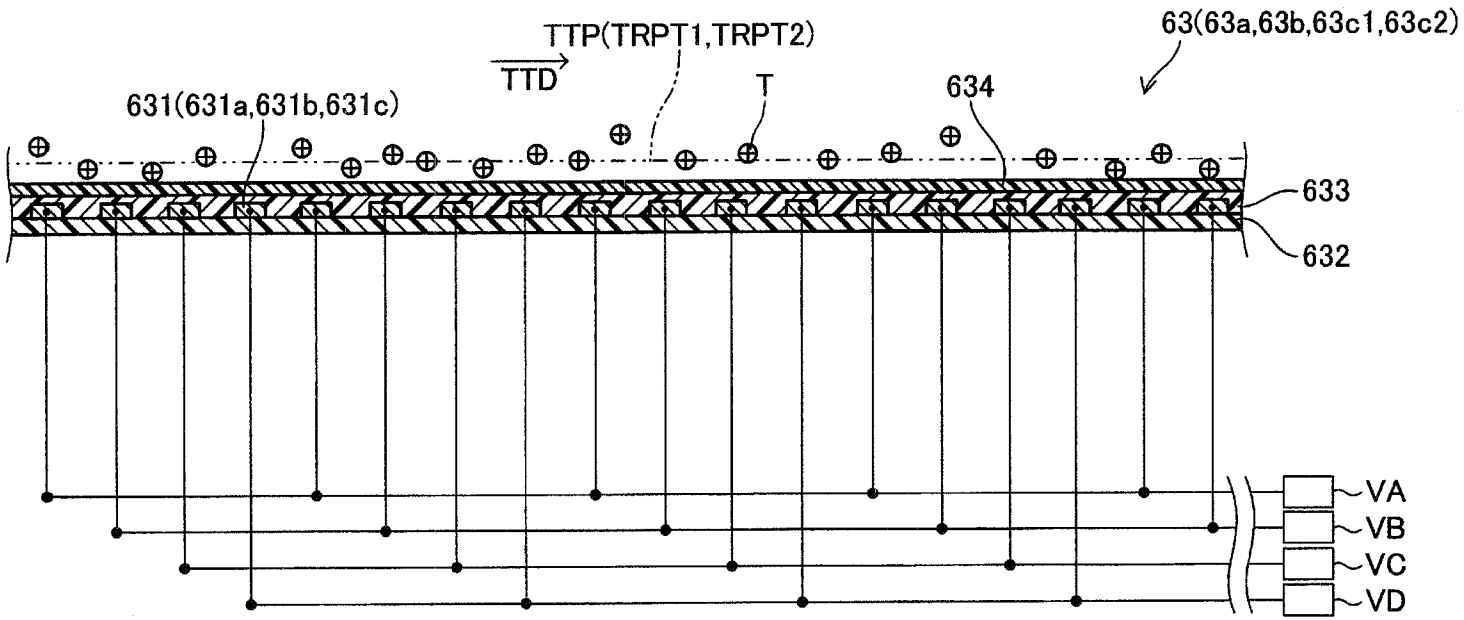
FIG. 3 is an enlarged cross-sectional side view of each transfer board for the toner supply device in the embodiment according to one or more aspects of the present invention.

Referring to FIG. 3, the transfer board 63 is a thin plate member configured in the same manner as a flexible printed-circuit board. Specifically, the transfer board 63 includes transfer electrodes 631, a transfer electrode supporting film 632, a transfer electrode coating layer 633, and a transfer electrode overcoating layer 634.

Each transfer electrode 631 is a linear wiring pattern having a longitudinal direction parallel to the main scanning direction. It is noted that the transfer electrodes 631 of the bottom transfer board 63*a* will be referred to as bottom transfer electrodes 631*a*, the transfer electrodes 631 of the vertical transfer board 63*b* will be referred to as vertical transfer electrodes 631*b*, and the transfer electrodes 631 of the first retrieving transfer board 63*c*1 and the second retrieving transfer board 63*c*2 will be referred to as retrieving transfer electrodes 631*c*. Further, for example, each transfer electrode 631 is formed with a copper thin film having a thickness of tens of micrometers. The transfer electrodes 631 are arranged parallel to each other along the toner transfer path TTP (note: in the cases of the first retrieving transfer board 63*c*1 and the second retrieving transfer board 63*c*2, along the first toner retrieving path TRPT1 and the second toner retrieving path TRPT2, respectively).

Every fourth one of the transfer electrodes 631, arranged along the toner transfer path TTP, is connected with a specific one of four power supply circuits VA, VB, VC, and VD. In other words, the transfer electrodes 631 are arranged along the toner transfer path TTP in the following order: a transfer electrode 631 connected with the power supply circuit VA, a transfer electrode 631 connected with the power supply circuit VB, a transfer electrode 631 connected with the power supply circuit VC, a transfer electrode 631 connected with the power supply circuit VD, a transfer electrode 631 connected with the power supply circuit VA, a transfer electrode 631 connected with the power supply circuit VB, a transfer electrode 631 connected with the power supply circuit VC, a transfer electrode 631 connected with the power supply circuit VD, . . . (note: the power supply circuits VA, VB, VC, and VD are included in each of the transfer power supply circuit 64, the first retrieving bias power supply 66*c*1, and the second retrieving bias power supply circuit 66*c*2).

FIG. 4 exemplifies output waveforms, which are respectively generated by the power supply circuits VA, VB, VC, and VD shown in FIG. 3. In the embodiment, as illustrated in FIG. 4, the power supply circuits VA, VB, VC, and VD are configured to generate respective AC driving voltages having substantially the same waveform. Further, the power supply circuits VA, VB, VC, and VD are configured to generate the respective AC driving voltages with a phase difference of 90 degrees between any adjacent two of the power supply circuits VA, VB, VC, and VD in the aforementioned order. In other words, the power supply circuits VA, VB, VC, and VD are configured to output the respective AC driving voltages each of which is delayed by a phase of 90 degrees behind the voltage output from a precedent adjacent one of the power supply circuits VA, VB, VC, and VD in the aforementioned order.

Thus, the transfer board 63 is configured to transfer the positively charged toner T in the toner transfer direction TTD under the traveling-wave electric field generated along the surface of the transfer board 63 when the aforementioned driving voltages are applied to the transfer electrodes 631.

The transfer electrodes 631 are formed on a surface of the transfer electrode supporting film 632. The transfer electrode supporting film 632 is a flexible film made of electrically insulated synthetic resin such as polyimide resin.

The transfer electrode coating layer 633 is made of electrically insulated synthetic resin. The transfer electrode coating layer 633 is provided to coat the transfer electrodes 631 and the surface of the transfer electrode supporting film 632 on which the transfer electrodes 631 are formed.

On the transfer electrode coating layer 633, the transfer electrode overcoating layer 634 is provided. Namely, the transfer electrode coating layer 633 is formed between the transfer electrode overcoating layer 634 and the transfer electrodes 631. The surface of the transfer electrode overcoating layer 634 is formed as a smooth surface with a very low level of irregularity, so as to smoothly convey the toner T.

<General Overview of Operations of Laser Printer>

Subsequently, a general overview will be provided of operations of the laser printer 1 configured as above with reference to the relevant drawings.

<<Sheet Feeding Operation>>

Referring to FIG. 1, firstly, a leading end of a sheet P placed on the feed tray (not shown) is fed to the registration rollers 21. The registration rollers 21 perform skew correction for the sheet P, and adjust a moment when the sheet P is to be fed forward. After that, the sheet P is fed to the transfer position TP.

<<Formation of Toner Image on Electrostatic Latent Image Holding Surface>>

While the sheet P is being conveyed to the transfer position TP as described above, an image of the toner T (hereinafter referred to as a toner image) is formed on the electrostatic latent image holding surface LS that is the outer circumferential surface of the photoconductive drum 3, as will be mentioned below.

<<Formation of Electrostatic Latent Image>>

Firstly, the electrostatic latent image holding surface LS of the photoconductive drum 3 is charged evenly and positively by the electrification device 4. The electrostatic latent image holding surface LS, charged by the electrification device 4, is moved along the auxiliary scanning direction to the scanned position SP to face the scanning unit 5, when the photoconductive drum 3 rotates in the direction indicated by arrows in FIG. 1.

In the scanned position SP, the electrostatic latent image holding surface LS is exposed to the laser beam LB modulated based on the image data. Namely, while being scanned along the main scanning direction, the laser beam LB is rendered incident onto the electrostatic latent image holding surface LS. In accordance with the modulation of the laser beam LB, areas with no positive charge remaining thereon are generated on the electrostatic latent image holding surface LS. Thereby, an electrostatic latent image is formed with a positive charge pattern (positive charges distributed in the shape of an image) on the electrostatic latent image holding surface LS.

The electrostatic latent image, formed on the electrostatic latent image holding surface LS, is transferred to the development position DP to face the toner supply device 6 when the photoconductive drum 3 rotates in the direction indicated by the arrows in FIG. 1.

<<Transfer and Supply of Charged Toner>>

Referring to FIGS. 2 and 3, the toner T stored in the toner box 61 is charged due to contact and/or friction with the transfer electrode overcoating layer 634 on the bottom transfer board 63*a*. The charged toner T, which is in contact with or proximity to the transfer electrode overcoating layer 634 on the bottom transfer board 63*a*, is conveyed in the toner transfer direction TTD, by the traveling-wave electric field generated when the aforementioned transfer bias voltage is applied to the bottom transfer electrodes 631*a*. Thereby, the charged toner T is smoothly transferred to the vertical transfer board 63*b*.

The vertical transfer board 63*b* conveys the toner T, received at the lower end of the vertical transfer board 63*b* from the bottom transfer board 63*a*, vertically up in the toner transfer direction TTD, by the traveling-wave electric field generated when the aforementioned transfer bias voltage is applied to the vertical transfer electrodes 631*b* of the vertical transfer board 63*b*. Here, the toner T transferred from the bottom transfer board 63*a* to the vertical transfer board 63*b* contains toner charged in an undesired manner as well (e.g., negatively charged toner, inadequately charged toner, and uncharged toner).

Nonetheless, in the embodiment, inappropriately charged toner leaves the toner transfer path TTP and drops from the vertical transfer board 63*b* by the action of the gravity and/or the aforementioned electric fields, when being conveyed vertically up toward the toner carrying position TCP by the vertical transfer board 63*b*, or being held and carried on the development roller 62 in the vicinity of the toner carrying position TCP by the electric field (the electric field generated by the aforementioned supply bias voltage) generated between the vertical transfer board 63*b* and the development roller 62.

Thereby, it is possible to selectively convey adequately charged toner T to the toner carrying position TCP. Namely, it is possible to discriminate the adequately charged toner T from the inappropriately charged toner T by the vertical transfer board 63*b*, in a favorable manner. The toner T, which has left the toner transfer path TTP and dropped, returns into the toner storage section 61*a*.

As described above, when the positively charged toner T is conveyed to the toner carrying position TCP by the vertical transfer board 63*b*, the toner T is held and carried on the toner holding surface 62*a* by the action of the aforementioned supply bias voltage. Then, when the development roller 62 is driven to rotate and the toner holding surface 62*a* moves to the development position DP, the toner T is supplied to (the vicinity of) the development position DP. In the vicinity of the development position DP, the electrostatic latent image formed on the electrostatic latent image holding surface LS is developed with the toner T. Namely, the toner T is transferred from the toner holding surface 62*a*, and adheres to the areas with no positive charge on the electrostatic latent image holding surface LS. Thereby, the toner image is formed and held on the electrostatic latent image holding surface LS.

The toner T, which has passed through the development position DP and still remains on the toner holding surface 62*a* without being consumed in the development position DP, is retrieved in the first-retrieving-side proximity position TRP1 by the first retrieving transfer board 63*c*1 by the action of the aforementioned first retrieving bias voltage. The first retrieving bias voltage is lower than the second retrieving bias voltage. Therefore, a part of the toner T remaining on the toner holding surface 62*a* is retrieved by the action of a relatively low intensity of electric field generated when the relatively low first retrieving bias is applied to the first retrieving transfer board 63*c*1. Thereby, it is possible to prevent in a favorable manner the toner T from being accumulated on the first retrieving transfer board 63*c*1.

The toner T, which is still left on the toner holding surface 62*a* without being completely retrieved in the first-retrieving-side proximity position TRP1 (typically, such toner T firmly adheres onto the toner holding surface 62*a* as being highly charged and/or powdered with a small particle diameter), moves up to the second-retrieving-side proximity position TRP2 in response to rotation of the development roller 62. Then, the toner T is retrieved in a favorable manner in the second-retrieving-side proximity position TRP2 by the action of the electric field generated when the second retrieving bias voltage higher than the first retrieving bias voltage is applied between the development roller 62 and the second retrieving transfer board 63*c*2.

Thus, in the embodiment, the toner T, which is left on the toner holding surface 62*a* having passed through the development position DP without being consumed in the development position DP, is retrieved in the different two positions, i.e., the first-retrieving-side proximity position TRP1 and the second-retrieving-side proximity position TRP2. Further, the second retrieving bias voltage is set to be higher than the first retrieving bias voltage. Thereby, it is possible to retrieve the toner T remaining on the toner holding surface 62*a*, in a favorable manner.

Namely, in the first-retrieving-side proximity position TRP1, by the action of the relatively low first retrieving bias voltage, a part of the toner T remaining on the toner holding surface 62*a* (mainly, which part includes a surface layer of the toner T adhering onto the toner holding surface 62*a* with a relatively low adhering force) is smoothly retrieved by the first retrieving transfer board 63*c*1, without being accumulated on the toner holding surface 62*a*. Then, the toner T firmly adhering onto the toner holding surface 62*a* that has not completely been retrieved in the first-retrieving-side proximity position TRP1 (which toner T includes a lower layer of the toner T beneath the surface layer) is retrieved in the subsequent second-retrieving-side proximity position TRP2 by the second retrieving transfer board 63*c*2, by the action of the relatively high second retrieving bias voltage. Therefore, the toner holding surface 62*a*, which has passed through the first-retrieving-side proximity position TRP1 and the second-retrieving-side proximity position TRP2, is in a state where the toner T is removed therefrom in a favorable manner (the toner T is hardly left thereon).

The toner T retrieved in the first-retrieving-side proximity position TRP1 is conveyed along the first toner retrieving path TRPT1 and returned into the toner storage section 61*a*. Further, the toner T retrieved in the second-retrieving-side position TRP2 is conveyed along the second toner retrieving path TRPT2 and returned into the toner storage section 61*a*.

Thus, according to the embodiment, it is possible to prevent in a favorable manner a ghost image that may be generated on a formed image when the toner holding surface 62*a* reaches again the toner carrying position TCP with the toner T remaining thereon in a shape of an inverted image (a negative image) of a previous formed image. Further, it is possible to prevent an undesired situation where the toner T is unnecessarily accumulated on the retrieving paths and/or unnecessarily charged up, as adequately as practicable.

<<Transfer of Toner Image from Electrostatic Latent Image Holding Surface onto Sheet>>

Referring to FIG. 1, the toner image, which is held on the electrostatic latent image holding surface LS of the photoconductive drum 3 as described above, is conveyed to the transfer position TP when the electrostatic latent image holding surface LS turns in the direction indicated by the arrows in FIG. 1. Then, in the transfer position TP, the toner image is transferred from the electrostatic latent image holding surface LS onto the sheet P.

<Operations and Effects>

Subsequently, an explanation will be provided about operations and effects that the toner supply device 6 of the embodiment provides, with reference to FIGS. 5 and 6. It is noted that in FIGS. 5 and 6, each of the first retrieving transfer board 63*c*1 and the second retrieving transfer board 63*c*2 shown in FIG. 2 will be referred to as a generic name "the retrieving transfer board 63*c*." Additionally, each of the first-retrieving-side proximity position TRP1 and the second-retrieving-side proximity position TRP2 shown in FIG. 2 will be referred to as a generic name "the retrieving-side proximity position TRP" or "the retrieving-side proximity position TRP0." Further, each of the first toner retrieving path TRPT1 and the second toner retrieving path TRPT2 shown in FIG. 2 will be referred to as a generic name "the toner retrieving path TRPT."

FIGS. 5 and 6 show results of electric field simulations (see arrows in FIGS. 5 and 6). It is noted that for the sake of simple calculation, the simulations are carried out with a surface potential of the development roller 62 (the toner holding surface 62*a*) set to +1500 V and an electric potential of each retrieving transfer electrode 631*c* set to one of two phases +500 V (for a vertically-striped electrode) and −100 V (for a horizontally-striped electrode).

In the following explanation, it is assumed that the retrieving transfer board 63*c* shown in FIG. 5 is the first retrieving transfer board 63*c*1 shown in FIG. 2. As shown in FIGS. 2 and 5, in the embodiment, the starting point on the first retrieving transfer board 63*c*1 in the toner transfer direction TTD is disposed in a position corresponding to the first-retrieving-side proximity position TRP1 (in FIG. 5, the retrieving-side proximity position TRP0). Nonetheless, the retrieving transfer electrodes 631*c* are disposed only at a downstream side relative to the first-retrieving-side proximity position TRP1 in the toner transfer direction TTD on the first toner retrieving path TRPT1. It is noted that FIG. 5 shows a simulation result under an assumption that there is not any transfer electrode supporting film 632 but only "air" between the retrieving-side proximity position TRP0 and the position TRP corresponding to the most upstream end of the retrieving transfer electrodes 631*c* in the toner transfer direction TTD. However, the condition as to whether there is a transfer electrode supporting film 632 therebetween does not exert any significant influence on the simulation result.

In such a configuration, as illustrated in FIG. 5, in areas on the toner transfer path TTP where the retrieving transfer electrodes 631*c* exist, electric field components for moving the toner T in the toner transfer direction TTD (downward in FIG. 2) are generated. Therefore, even when the moving direction of the toner holding surface 62*a* moving in response to rotation of the development roller 62 is downward in FIG. 5 as well as the toner transfer direction YID, the toner T retrieved from the toner holding surface 62*a* is smoothly conveyed in the toner transfer direction TTD (downward in FIG. 5).

On the contrary, as depicted in FIG. 6, when the moving direction of the toner holding surface 62*a* moving in response to rotation of the development roller 62 is downward in the first-retrieving-side proximity position TRP1 (see FIG. 2: i.e., the retrieving-side proximity position TRP in FIG. 6) as well as the toner transfer direction TTD and the retrieving transfer electrodes 631*c* exist at an upstream side (at an upper side in FIG. 6) as well relative to the first-retrieving-side proximity position TRP1 in the toner transfer direction TTD, an operation of retrieving the toner T from the toner holding surface 62*a* begins at an upstream side relative to the first-retrieving-side proximity position TRP1 in the toner transfer direction TTD.

Here, referring to FIG. 6, in the vicinity of the retrieving-side proximity position TRP, there is an area where an electric field component parallel to the toner transfer direction TTD is not generated (namely, only rightward electric field components are generated in FIG. 6). In the area, an electric field component for moving the toner T along the toner transfer direction TTD, contained in the traveling-wave transfer electric field generated when the retrieving bias voltage containing a multi-phase AC voltage component is applied to the retrieving transfer electrodes 631*c*, is lower than around the area. Hence, in the case where an operation of retrieving the toner T from the toner holding surface 62*a* begins at an upstream side relative to the first-retrieving-side proximity position TRP in the toner transfer direction TTD, when the retrieved toner T reaches the vicinity of the retrieving-side proximity position TRP, the retrieved toner T becomes stuck in the area.

Meanwhile, the following explanation will be provided under an assumption that the retrieving transfer board 63*c* shown in FIG. 6 is the second retrieving transfer board 63*c*2 shown in FIG. 2. As shown in FIGS. 2 and 6, in the embodiment, the moving direction of the toner holding surface 62*a* moving in response to rotation of the development roller 62 is opposite to the toner transfer direction TTD (downward in FIG. 6) in the second-retrieving-side proximity position TRP2 (in FIG. 6, the retrieving-side proximity position TRP). Further, the retrieving transfer electrodes 631*c* are disposed over a range from an upstream side to a downstream side relative to the second-retrieving-side proximity position TRP2.

In such a configuration, in a downstream area (downside in FIG. 6) relative to the second-retrieving-side proximity position TRP2 in the toner transfer direction TTD, an operation of retrieving the toner T from the toner holding surface 62*a* begins. In this case, the toner T retrieved from the toner holding surface 62*a* is smoothly transferred in the toner transfer direction TTD (downward in FIG. 6).

As described above in detail, in the embodiment, each retrieving transfer board 63*c* is configured to retrieve the toner T at a downstream side relative to the retrieving-side proximity position TRP in the toner transfer direction TTD. Specifically, in the first retrieving transfer board 63*c*1, the retrieving transfer electrodes 631*c* are disposed only at a downstream side relative to the first-retrieving-side proximity position TRP1 in the toner transfer direction TTD on the first toner retrieving path TRPT1. Further, in the second retrieving transfer board 63*c*2, the toner T is conveyed in the direction opposite to the moving direction of the toner holding surface 62*a* moving in response to rotation of the development roller 62, in the second-retrieving-side proximity position TRP2. Accordingly, in the embodiment, it is possible to retrieve the toner T from the development roller 62 (the toner holding surface 62*a*) in a favorable manner.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are feasible.

Aspects of the present invention may be applied to electrophotographic image forming apparatuses such as color laser printers, and monochrome and color copy machines, as well as the single-color laser printer as exemplified in the aforementioned embodiment. Further, the photoconductive body is not limited to the drum-shaped one as exemplified in the aforementioned embodiment. For instance, the photoconductive body may be formed in shape of a plate or an endless belt.

Additionally, light sources (e.g., LEDs, electroluminescence devices, and fluorescent substances) other than a laser scanner may be employed as light sources for exposure. In such cases, the "main scanning direction" may be parallel to a direction in which light emitting elements such as LEDs are aligned.

Further, for example, aspects of the present invention may be applied to negatively chargeable development agent or a negatively chargeable photoconductive body.

Alternatively, aspects of the present invention may be applied to image forming apparatuses employing methods other than the aforementioned electrophotographic method (e.g., a toner-jet method using no photoconductive body, an ion flow method, and a multi-stylus electrode method).

The development roller 62 may be disposed such that the toner holding surface 62*a* contacts the electrostatic latent image holding surface LS in the development position DP. Further, the development roller 62 may be substitutable for a cylindrical development sleeve. Further, the toner supply device 6 may be configured without the development roller 62 (or a cylindrical development sleeve). In this case, in the position where the development roller 62 is disposed in FIG. 2, the photoconductive drum 3 may be disposed. Furthermore, the transfer board 63 may carry out development of the electrostatic latent image and retrieving of the toner T left on the photoconductive drum 3 after the toner image is transferred onto the sheet P.

The configuration of the transfer board 63 is not limited to that as exemplified in the aforementioned embodiment. For example, the transfer electrode overcoating layer 634 may not necessarily be provided. Alternatively, the transfer electrodes 631 may be implanted in the transfer electrode supporting film 632. In this case, the transfer board 63 may be configured without the transfer electrode coating layer 633 or the transfer electrode overcoating layer 634.

The transfer board 63 (at least one of the vertical transfer board 63*b*, the first retrieving transfer board 63*c*1, and the second retrieving transfer board 63*c*2) may contact the development roller 62. A central portion of the bottom transfer board 63*a* may be flat. Namely, only a joint portion of the bottom transfer board 63*a* with the lower end of the vertical transfer board 63*b* may be curved.

The bottom transfer board 63*a* may be configured as a separate board from the vertical transfer board 63*b*. In this case, the bottom transfer board 63*a* and the vertical transfer board 63*b* may be connected with respective different power supplies. The vertical transfer board 63*b* may be slightly tilted as far as it extends substantially along the up-to-down direction. Further, the first retrieving transfer board 63*c*1 may be slightly tilted. The lower end of the first retrieving transfer board 63*c*1 may be connected with the bottom transfer board 63*a*.

The gap formed in the first-retrieving-side proximity position TRP1 may be identical to or different from the gap formed in the second-retrieving-side proximity position TRP2 (as mentioned above, at least one of the first retrieving transfer board 63*c*1 and the second retrieving transfer board 63*c*2 may contact the development roller 62).

The toner supply device 6 may be configured without the first retrieving transfer board 63*c*1 or the second retrieving transfer board 63*c*2. Further, needless to describe, a third retrieving transfer board may be provided as well as the first retrieving transfer board 63*c*1 and the second retrieving transfer board 63*c*2.

In the aforementioned embodiment, the starting point (the upstream end) of the first retrieving transfer board 63*c*1 is disposed in the position corresponding to the rotation center of the development roller 62 (see a dashed line in FIG. 5). However, for example, the starting point (the upstream end) of the first retrieving transfer board 63*c*1 may be placed in a position lower than the rotation center of the development roller 62 (see a solid line in FIG. 5).

FIG. 7 is a cross-sectional side view showing a configuration of a toner supply device 6 in a modification according to aspects of the present invention. As depicted in FIG. 7, a retrieving roller 67 may be provided between the development roller 62 and the first retrieving transfer board 63*c*1. The retrieving roller 67 may be a substantially cylindrical rotational body, which may be housed in the toner box 61 so as to face the development roller 62 across a predetermined distance of gap in a toner retrieving position TRP' that is downstream relative to the development position DP and upstream relative to the toner carrying position TCP in the moving direction of the toner holding surface 62*a* moving in response to rotation of the development roller 62.

The retrieving roller 67 may be electrically connected with a third retrieving bias power supply circuit 66*c*3, so as to retrieve the toner T from the toner holding surface 62*a* when a predetermined retrieving bias voltage is applied between the retrieving roller 67 and the development roller 62. Namely, the first retrieving transfer board 63*c*1 may be configured to further retrieve, from a circumferential surface of the retrieving roller 67, the toner T retrieved from the toner holding surface 62*a* by the retrieving roller 67, and to convey the retrieved toner T toward the toner storage section 61*a*.

In the modification, the retrieving roller 67 is driven to rotate in a direction (counterclockwise in FIG. 7) opposite to the rotational direction of the development roller 62, such that a moving direction of the circumferential surface of the retrieving roller 67 is identical to the moving direction of the toner holding surface 62*a* in the toner retrieving position TRP'. Further, the retrieving roller 67 is disposed to be in closest proximity to and opposite the toner transfer surface TTS of the first retrieving transfer board 63*c*1 across a predetermined distance of gap in the first-retrieving-side proximity position TRP1. Further, the first retrieving transfer board 63*c*1 is provided such that the toner transfer direction TTD, in the first-retrieving-side proximity position TRP1, is opposite to the moving direction of the circumferential surface of the retrieving roller 67 moving in response to rotation of the retrieving roller 67.

In such a configuration, the toner T, which still remains on the toner holding surface 62*a* (without being consumed in the development position DP), reaches the vicinity of the toner retrieving position TRP' in response to rotation of the development roller 62. In the vicinity of the toner retrieving position TRP', the toner T transfers (jumps) onto the retrieving roller 67 to which the retrieving bias voltage is applied. Namely, the toner T, which remains on the toner holding surface 62*a* having passed through the development position DP, is retrieved by the retrieving roller 67.

The retrieving roller 67 is configured to rotate while retrieving the toner T from the toner holding surface 62*a*. The toner T, which adheres onto the circumferential surface of the retrieving roller 67 after retrieved by the retrieving roller 67, are further retrieved by the first retrieving transfer board 63*c*1 in the vicinity of the first-retrieving-side proximity position TRP1 substantially opposite the toner retrieving position TRP' across the retrieving roller 67. Then, the toner T is returned into the toner storage section 61*a*.

At this time, in the first-retrieving-side proximity position TRP1, the moving direction of the circumferential surface of the retrieving roller 67 moving in response to rotation of the retrieving roller 67 is opposite to the toner transfer direction TTD of the first retrieving transfer board 63*c*1. Therefore, in the same way as described in the aforementioned embodiment, the toner T is retrieved from the retrieving roller 67 by the first retrieving transfer board 63*c*1 in a favorable manner. Thus, the circumferential surface of the retrieving roller 67, where the amount of the toner T adhering thereto is adequately reduced, is sequentially supplied to the toner retrieving position TRP'. Accordingly, according to the toner supply device 6 configured as above, it is possible to retrieve the toner T from the development roller 62 (the toner holding surface 62*a*) in a more favorable manner.

Furthermore, for instance, the voltage applied to the development roller 62 may consist of only a DC voltage component. Referring to FIG. 4, the waveform of the voltage output from each of the power supply circuits VA, VB, VC, and VD may be a sinusoidal waveform or a triangle waveform, instead of the rectangular waveform as exemplified in the aforementioned embodiment.

In the aforementioned embodiment, the four power supply circuits VA, VB, VC, and VD are provided to generate respective transfer biases with a phase difference of 90 degrees between any adjacent two of the four power supply circuits VA, VB, VC, and VD in the aforementioned order. However, three power supply circuits may be provided to generate respective transfer biases with a phase difference of 120 degrees between any two of the three power supply circuits.

What is claimed is:

1. A developer supply device configured to supply charged development agent to an intended device, the developer supply device comprising:

a casing comprising a developer storage section configured to accommodate the development agent to be supplied;

a developer holding member comprising:

a developer holding surface formed as a cylindrical circumferential surface parallel to a first direction, the developer holding surface being disposed to face the intended device in a first position outside the casing, the developer holding member being configured to rotate around an axis parallel to the first direction such that the developer holding surface moves in a second direction perpendicular to the first direction;

a developer transfer unit configured to transfer the development agent from the developer storage section onto the developer holding surface in a second position upstream relative to the first position in the second direction;

a first developer retrieving board comprising a plurality of retrieving transfer electrodes arranged along a first developer retrieving path perpendicular to the first direction, the first developer retrieving board being disposed in closest proximity to the developer holding surface across a predetermined distance in a first retrieving proximity position that is downstream relative to the first position and upstream relative to the second position in the second direction, the first developer retrieving board being configured to retrieve the development agent from the developer holding surface in a position downstream relative to the first retrieving proximity position in a first developer transfer direction along the first developer retrieving path, under an electric field generated when a retrieving bias voltage is applied between the developer holding member and the first developer retrieving board, and to transfer the retrieved development agent toward the developer storage section in the first developer transfer direction along the first developer retrieving path, and a second developer retrieving board disposed in closest proximity to the developer holding surface across a predetermined distance in a second retrieving proximity position that is downstream relative to the first retrieving proximity position and upstream relative to the second position in the second direction, and wherein the second developer retrieving board is configured to retrieve the development agent remaining on the developer holding surface without being retrieved around the first retrieving proximity position, in a position downstream relative to the second retrieving proximity position in a second developer transfer direction along a second developer retrieving path perpendicular to the first direction, under an electric field generated when a second retrieving bias voltage is applied between the developer holding member and the second developer retrieving board, and to transfer the retrieved development agent toward the developer storage section in the second developer transfer direction along the second developer retrieving path.

2. The developer supply device according to claim 1, wherein the developer holding member is driven to rotate in such a rotational direction that in the first retrieving proximity position, the second direction in which the developer holding surface moves is identical to the first developer transfer direction in which the retrieved development agent is transferred along the first developer retrieving path, and wherein the retrieving transfer electrodes are disposed only at a downstream side relative to the first retrieving proximity position in the first developer transfer direction along the first developer retrieving path.

3. The developer supply device according to claim 1, wherein the second developer retrieving board is configured such that in the second retrieving proximity position, the second developer transfer direction in which the retrieved development agent is transferred along the second developer retrieving path is opposite to the second direction in which the developer holding surface moves.

4. The developer supply device according to claim 1, wherein the first developer retrieving board comprises a retrieving transfer surface forming the first developer retrieving path, the retrieving transfer surface facing the developer holding surface.

5. The developer supply device according to claim 1, wherein the developer transfer unit comprises a developer supply board disposed to face the developer holding surface in the second position, wherein the developer supply board comprises a plurality of supply transfer electrodes arranged along a developer supply path perpendicular to the first direction, and wherein the developer supply board is configured to transfer the development agent from the developer storage section to the second position under a traveling-wave electric field generated when a transfer bias containing a multi-phase alternating-current voltage component is applied to the supply transfer electrodes.

6. A developer retrieving device configured to retrieve charged development agent from a developer holding surface formed as a cylindrical circumferential surface parallel to a first direction, the developer retrieving device comprising:

a first developer retrieving board comprising a plurality of retrieving transfer electrodes arranged along a first developer retrieving path perpendicular to the first direction, the developer retrieving board being disposed in closest proximity to the developer holding surface across a predetermined distance in a first retrieving proximity position upstream relative to a developer carrying position, in which the developer holding surface holds and carries the development agent, in a second direction that is a moving direction of the developer holding surface and perpendicular to the first direction, the first developer retrieving board being configured to retrieve the development agent from the developer holding surface in a position downstream relative to the first retrieving proximity position in a first developer transfer direction along the first developer retrieving path, under an electric field generated when a retrieving bias voltage is applied between the developer holding member and the first developer retrieving board, and to transfer the retrieved development agent toward a position farther from the first retrieving proximity position in the first developer transfer direction along the developer retrieving path, and a second developer retrieving board disposed in closest proximity to the developer holding surface across a predetermined distance in a second retrieving proximity position that is downstream relative to the first retrieving proximity position and upstream relative to the developer carrying position in the second direction, and wherein the second developer retrieving board is configured to retrieve the development agent remaining on the developer holding surface without being retrieved around the first retrieving proximity position, in a position downstream relative to the second retrieving proximity position in a second developer transfer direction along a second developer retrieving path perpendicular to the first direction, under an electric field generated when a second retrieving bias voltage is applied between the developer holding member and the second developer retrieving board, and to transfer the retrieved development agent toward a position farther from the second retrieving proximity position in the second developer transfer direction along the second developer retrieving path.

7. The developer retrieving device according to claim 6, wherein in the first retrieving proximity position, the first developer transfer direction in which the retrieved development agent is transferred along the first developer retrieving path is identical to the second direction in which the developer holding surface moves, and wherein the retrieving transfer electrodes are disposed only at a downstream side relative to the first retrieving proximity position in the first developer transfer direction along the first developer retrieving path.

8. The developer retrieving device according to claim 6, wherein in the second retrieving proximity position, the second developer transfer direction in which the retrieved development agent is transferred along the second developer retrieving path is opposite to the second direction in which the developer holding surface moves.

9. The developer retrieving device according to claim 6, wherein the first developer retrieving board comprises a retrieving transfer surface forming the first developer retrieving path, the retrieving transfer surface facing the developer holding surface.

10. An image forming apparatus comprising:

a photoconductive body configured such that a development agent image is formed thereon; and a developer supply device configured to supply charged development agent to the photoconductive body, the developer supply device comprising:

a casing comprising a developer storage section configured to accommodate the development agent to be supplied;

a developer holding member comprising:

a developer holding surface formed as a cylindrical circumferential surface parallel to a first direction, the developer holding surface being disposed to face the photoconductive body in a first position outside the casing, the developer holding member being configured to rotate around an axis parallel to the first direction such that the developer holding surface moves in a second direction perpendicular to the first direction;

a developer transfer unit configured to transfer the development agent from the developer storage section onto the developer holding surface in a second position upstream relative to the first position in the second direction;

a first developer retrieving board comprising a plurality of retrieving transfer electrodes arranged along a first developer retrieving path perpendicular to the first direction, the first developer retrieving board being disposed in closest proximity to the developer holding surface across a predetermined distance in a first retrieving proximity position that is downstream relative to the first position and upstream relative to the second position in the second direction, the first developer retrieving board being configured to retrieve the development agent from the developer holding surface in a position downstream relative to the first retrieving proximity position in a first developer transfer direction along the first developer retrieving path, under an electric field generated when a retrieving bias voltage is applied between the developer holding member and the first developer retrieving board, and to transfer the retrieved development agent toward the developer storage section in the first developer transfer direction along the first developer retrieving path, and a second developer retrieving board disposed in closest proximity to the developer holding surface across a predetermined distance in a second retrieving proximity position that is downstream relative to the retrieving proximity position and upstream relative to the second position in the second direction, and wherein the second developer retrieving board is configured to retrieve the development agent remaining on the developer holding surface without being retrieved around the first retrieving proximity position, in a position downstream relative to the second retrieving proximity position in a second developer transfer direction along a second developer retrieving path perpendicular to the first direction, under an electric field generated when a second retrieving bias voltage is applied between the developer holding member and the second developer retrieving board, and to transfer the retrieved development agent toward the developer storage section in the second developer transfer direction along the second developer retrieving path.

11. The image forming apparatus according to claim 10, wherein the developer holding member is driven to rotate in such a rotational direction that in the first retrieving proximity position, the second direction in which the developer holding surface moves is identical to the first developer transfer direction in which the retrieved development agent is transferred along the first developer retrieving path, and wherein the retrieving transfer electrodes are disposed only at a downstream side relative to the first retrieving proximity position in the first developer transfer direction along the first developer retrieving path.

12. The image forming apparatus according to claim 10, wherein the second developer retrieving board is configured such that in the second retrieving proximity position, the second developer transfer direction in which the retrieved development agent is transferred along the second developer retrieving path is opposite to the second direction in which the developer holding surface moves.

* * * * *